US010688512B2

(12) United States Patent
Moretti

(10) Patent No.: US 10,688,512 B2
(45) Date of Patent: Jun. 23, 2020

(54) CONTAINER OF FLUID SUBSTANCES FEATURING A MOBILE BOTTOM, WITH HERMETIC SEALING SYSTEM AND METHOD OF USE

(71) Applicant: LUMSON S.p.A., Capergnanica (CR) (IT)

(72) Inventor: Matteo Moretti, Crema (IT)

(73) Assignee: LUMSON S.P.A., Capergnanica (CR) (IT)

( * ) Notice: Subject to any disclaimer, the term of this patent is extended or adjusted under 35 U.S.C. 154(b) by 135 days.

(21) Appl. No.: 15/982,509

(22) Filed: May 17, 2018

(65) Prior Publication Data

US 2018/0339304 A1 Nov. 29, 2018

(30) Foreign Application Priority Data

May 24, 2017 (IT) ..... 102017000056483

(51) Int. Cl.
*B05B 11/00* (2006.01)
*B65D 51/00* (2006.01)
(Continued)

(52) U.S. Cl.
CPC ..... *B05B 11/0056* (2013.01); *B05B 11/0097* (2013.01); *B05B 11/00416* (2018.08);
(Continued)

(58) Field of Classification Search
CPC ..... B05B 11/0056; B05B 11/00416; B05B 11/0097; B05B 11/3047; B05B 31/025;
(Continued)

(56) References Cited

U.S. PATENT DOCUMENTS 2,863,699 A * 12/1958 Elser ..... B65D 83/14 222/402.24
3,381,863 A * 5/1968 Towns ..... B65D 83/64 222/386.5
(Continued)

FOREIGN PATENT DOCUMENTS

DE 19832824 A1 2/2000
EP 0546898 A1 6/1993
(Continued)

OTHER PUBLICATIONS

Search Report and Written Opinion dated Feb. 7, 2018 for Italian patent application No. 201700056483.

*Primary Examiner* — Timothy L Maust
*Assistant Examiner* — James R Hakomaki
(74) *Attorney, Agent, or Firm* — Vorys, Sater, Seymour and Pease LLP

(57) ABSTRACT

Container, including a body delimiting a cavity to contain fluid substance. A mobile bottom, inside the cavity, sealedly movable along the body internal wall. The body sealedly coupled to a collar having a surface resting on the body and a tubular member extending from the bottom thereof. The tubular member defining a first passage through which the fluid substance flows in use. An insert housed within the collar and formed of first and second parts, connected by a first breakable portion. A shutter housed, in a sealed manner, inside the insert and formed of first and second sections mutually connected by a second breakable portion. The second section including a surface to cooperate, in a sealed manner, with the tubular member when the second section is fitted thereon and a breakable wall which, when broken, permits access to the cavity.

20 Claims, 4 Drawing Sheets

(51) Int. Cl.
*B65B 31/02* (2006.01)
*B65D 83/42* (2006.01)
*B65D 1/02* (2006.01)

(52) U.S. Cl.
CPC ..... *B05B 11/3047* (2013.01); *B65B 31/025* (2013.01); *B65D 51/002* (2013.01); *B65D 83/42* (2013.01); *B05B 11/00444* (2018.08); *B65D 1/0238* (2013.01); *B65D 2251/0096* (2013.01)

(58) Field of Classification Search
CPC . B05B 11/00444; B65D 51/002; B65D 83/42; B65D 1/0238; B65D 2251/0096; B65D 2751/0096; B65B 31/025
USPC ..... 141/2
See application file for complete search history.

(56) References Cited

U.S. PATENT DOCUMENTS 5,417,258 A 5/1995 Privas
5,522,526 A * 6/1996 DeLaforcade ..... B05B 9/0838 222/1
5,577,641 A * 11/1996 De Laforcade ..... B29C 45/1676 222/386
5,836,479 A 11/1998 Klima et al.
6,230,943 B1 * 5/2001 Miyamoto ..... B65D 83/62 222/1
6,527,150 B2 * 3/2003 Benoist ..... B65D 83/62 222/1
2002/0020715 A1 * 2/2002 Gueret ..... B05B 7/2462 222/153.11
2004/0074925 A1 4/2004 Faurie
2005/0029307 A1 2/2005 Py et al.
2006/0261092 A1 * 11/2006 Ophardt ..... B05B 11/306 222/181.1
2015/0090739 A1 * 4/2015 Jung ..... B05B 11/3025 222/205
2016/0088921 A1 * 3/2016 Jo ..... B05B 11/3052 222/173
2017/0036227 A1 2/2017 Muller
2017/0082475 A1 * 3/2017 Ham ..... B05B 11/3042
2018/0339845 A1 11/2018 Moretti

FOREIGN PATENT DOCUMENTS

EP 2153908 A1 2/2010
EP 2197589 6/2010
EP 2598408 6/2013
FR 2668119 A2 4/1992
FR 2695111 A1 3/1994
FR 2730708 A1 8/1996

* cited by examiner

CONTAINER OF FLUID SUBSTANCES FEATURING A MOBILE BOTTOM, WITH HERMETIC SEALING SYSTEM AND METHOD OF USE

CROSS REFERENCE TO RELATED APPLICATION

This claims the benefit of Italian patent application no. 102017000056483, filed May 24, 2017, incorporated by reference.

FIELD OF THE INVENTION

The present invention relates to a container of fluid substances with a mobile bottom and a method for the filling and use thereof.

In particular, it relates to a container of fluid substances of the cosmetic, medical, or food kind, dispensable by means of a manual airless pump.

BACKGROUND ART

In the sector, there are known containers with mobile bottom which, when coupled with airless pumps, allow the dispensing of a product contained in the container without the said product being contaminated by the air present in the external environment. Each time the pump is operated, part of the fluid is expelled and the bottom rises slightly, in order to compensate for the fall in volume due to the expulsion of the product dispensed by the pump.

One problem experienced with these containers concerns the filling which must be carried out before coupling the container to the pump.

For some fluid products, especially cosmetic or medical products, which must therefore be handled with considerable care, the filling step is critical since it must be carried out using appropriate systems within a controlled environment. In fact, most of these fluids must not come into contact with air or with contaminating environments.

To solve this problem, the filling step and the step consisting of coupling the pump to the container are carried out almost simultaneously and within the same controlled atmosphere environment. In this way, it is certain that there is no contamination of the fluid introduced into the container, since once the pump is coupled, the system is sealed and hermetic and can no longer be contaminated.

The methodology described above is effective but involves high costs and flexibility problems deriving from the need to provide controlled environments in which two essentially independent steps take place, namely that consisting of filling the container and that consisting of sealing (by means of the pump) the filled container.

FR2730708-A1 and FR2695111-A1 show valve systems which are applicable to a container where, instead of the mobile bottom, a deformable bag is envisaged. These solutions aim to seal off the container and the contents thereof immediately after the filling step, thereby allowing the pump to be coupled later on.

However, these solutions are not very effective, especially if coupled with containers with a mobile bottom, as they do not always guarantee good sealing off of the contents. In fact, the closure of the container after filling is performed by valves made of an elastic material (silicone, rubber, etc.) which do not guarantee a hermetic seal, especially if the filling pressure is not optimal (for example, when the container with a mobile bottom is only partially filled, i.e. with an amount of fluid which is lower than the maximum capacity).

Another problem encountered with the prior art is that the traditional top-fill valves described in the aforesaid patent documents do not envisage the provision, prior to filling, of a container with a mobile bottom from which the air has been removed (i.e. vacuum-sealed or depressurised).

In fact, when coupled to a depressurised container with a mobile bottom and placed in a room pressure environment, the commonly known valves would open, allowing the entry of (possibly contaminated) air into the said container.

SUMMARY OF INVENTION

The object of the present invention is to provide a container and a method for the filling and use thereof which is improved compared with the prior art.

Another object of the invention is to provide a container which, once filled, guarantees optimal sealing off of the fluid substance inside the container, even if the pump is not installed immediately.

This and other objects are achieved by means of a container and a method for the use thereof according to the technical teachings of the claims annexed hereto.

Advantageously, in certain embodiments, a container according to the invention may be provided, prior to the filling step, which is depressurised or vacuum-sealed.

Advantageously, the container according to the present invention also features a plurality of seals which make it possible to verify—both during the filling step and during the pump/container coupling step—whether the container and the fluid contained therein are perfectly intact.

BRIEF DESCRIPTION OF THE FIGURES

Further characteristics and advantages of the invention will become clearer in the description of a preferred but not exclusive embodiment of the device, illustrated—by way of a non-limiting example—in the drawings annexed hereto, in which.

DETAILED DESCRIPTION OF THE INVENTION

Figure 1:
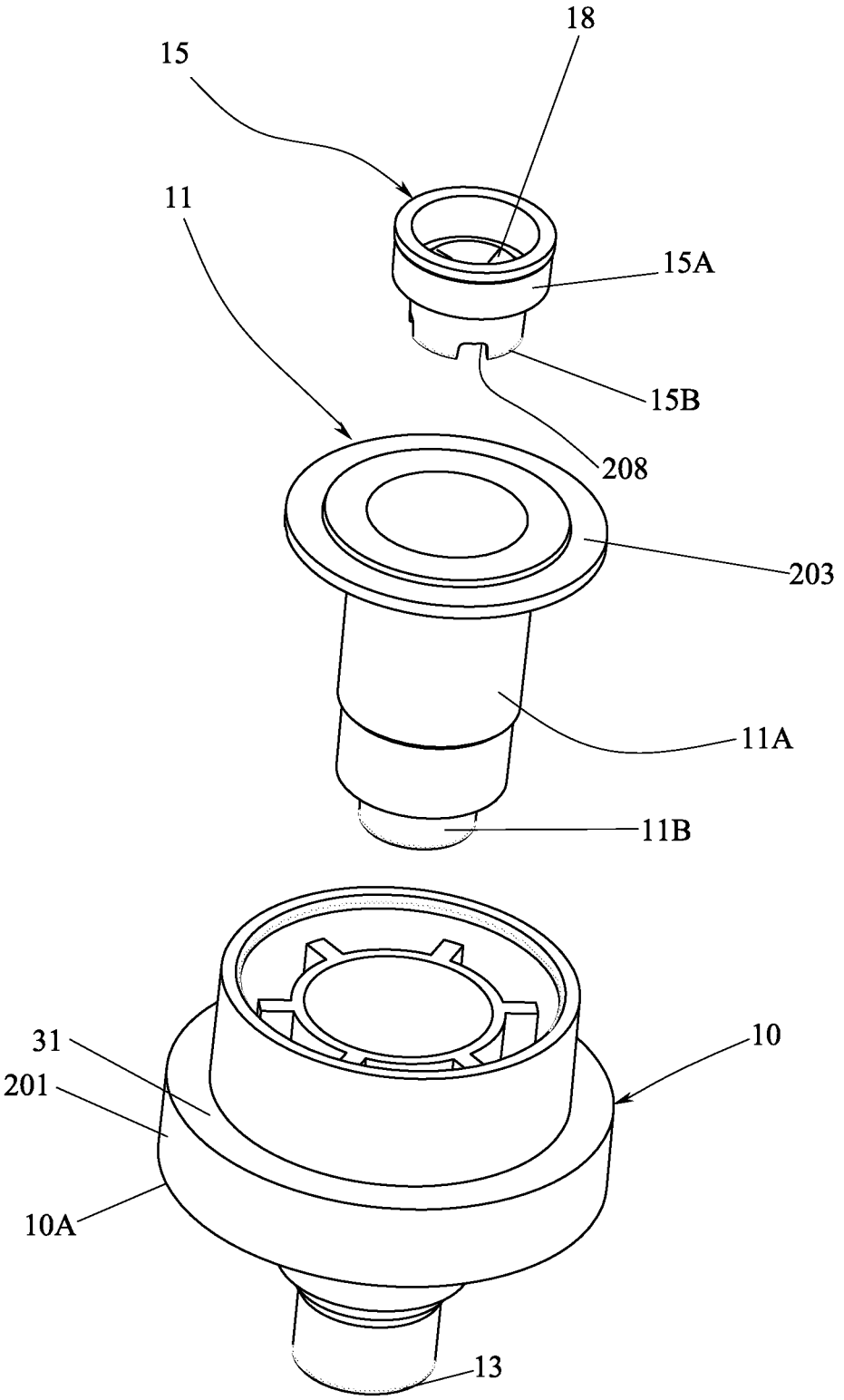
FIG. 1 is an exploded perspective view of a certain parts which form the container according to the present invention.

With reference to the figures stated, reference number 1 is used to denote, as a whole, a container.

The container 1 is configured to contain and dispense (when coupled with a pump) a fluid substance contained there within.

In the present wording, the term "fluid substance" is intended as a substance with a liquid or creamy consistency, which may be, for example, a cosmetic cream, a perfume, a medicine, a gel, a lacquer, a hair product, etc.

The container 1 comprises an external body 5 (or recipient), which may be, for example, a vial made of glass or plastic, and may be either transparent or not, or another suitable material.

The external body may have a neck 6 delimiting an opening 7 permitting access to a cavity 7A in the said body.

In the figures shown, the neck 6 has a diameter which is essentially flush with the external wall of the recipient, so that the section of the opening delimited by the neck is similar to the maximum internal diameter of the recipient; nevertheless, it is also possible to use vials, bottles etc., with a neck which is smaller in section than the body 5.

Inside the body 5 there is a movable base 500 envisaged, of a conventional type, which is equipped with sealing lips 501 on an internal wall 5C of the body, which preferably has at least one cylindrical section.

A collar 10 is then permanently coupled to the body 5, in a sealed manner, as shown in the figure. The collar 10 may be secured to the body by means of a snap-fitting, a thread, or another coupling means suitable to guarantee a seal.

In the embodiment described, the collar 10 is a rigid element. In the present document, 'rigid' means a body with dimensional stability at room temperature and pressure, for example, a body formed of plastic material.

Obviously, between the collar 10 and the body 5, there may be intermediate elements envisaged, which will not be described here.

The collar 10 may feature at least one surface 10A resting on the body 5. In the case illustrated, the resting surface may be delimited by a free end 31 of a skirt 201, from which a flange 200 may extend and may surround the neck 6 externally.

In one embodiment, the collar 10 may feature an abutment 503 (only shown in some of the drawings) for snap-fastening a pump 100, as will be seen later. In some variants, the abutment may be replaced by a thread or by any other means suitable for fastening the pump 100.

Figure 2:
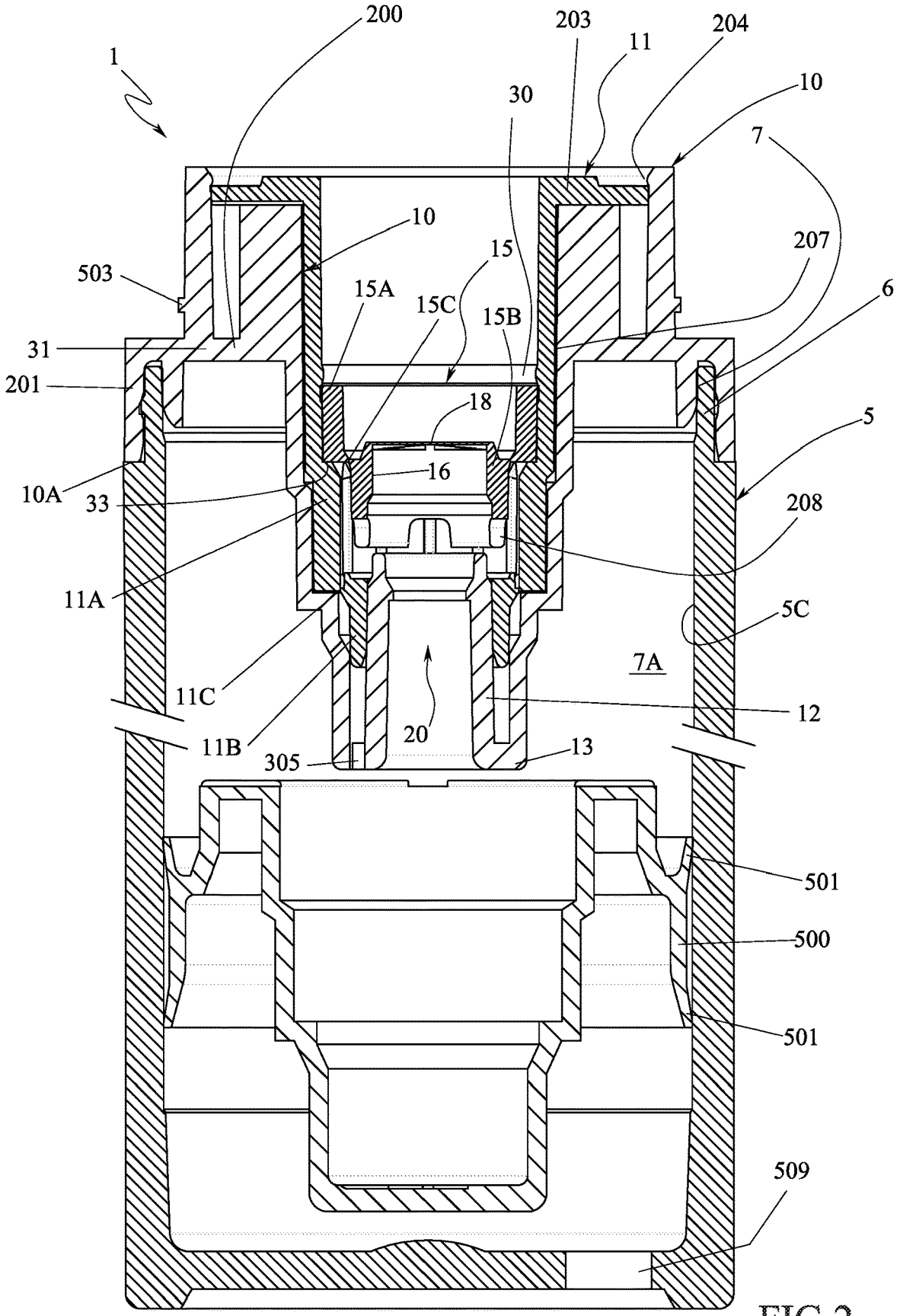
FIG. 2 is a simplified section of the various parts in FIG. 1 assembled together and coupled with a container with a mobile bottom.

As can be seen in FIG. 2, the collar has at least one part which is cup-shaped and from the bottom 13 thereof, a tubular member 12 may protrude, defining a first passage 20 for the fluid substance, in both a filling configuration and a use configuration.

In practice, the passage 20, defined by the tubular member 12, permits access to and from the interior of the cavity 7A inside the body 5.

In FIG. 2 (which shows a configuration in which the cavity 7A is empty and the bottom 500 is at half-stroke (but it will be shown later on that other configurations are possible in which the cavity 7A mat be provided depressurised, vacuum-sealed or with the bottom practically next to the collar 10), it can be seen that the collar 10 houses an insert 11. A gap 207 is envisaged between the insert 11 and the collar 10 for the passage of air, which is in a possible position as shown denoted by 207, even though the passage defined by the gap 207 may also be envisaged elsewhere.

The insert 11 is formed of a first part 11A and a second part 11B, which are mutually connected by a first breakable portion 11C.

The insert 11 may also feature a further flange 203, which, besides constituting a stop for insert positioning with respect to the collar, can also engage therewith by means of a snap-fit coupling. The protrusions 204 which allow such coupling can be seen in FIG. 1.

Also in FIG. 2, it can be seen that there is a shutter 15 housed inside the insert 11, preferably in a sealed manner, the said shutter being formed of a first section 15A and a second section 15B, which are mutually secured by a second breakable portion 15C.

The first section of the shutter 15A may be held in position within the insert 11, on the top, by a rib 30 protruding from an inner surface of the insert 11 and/or by a step 33 on the bottom, featured on an internal surface of the insert 11. The rib 30 may be configured to deform slightly (in an elastic manner) during insertion of the shutter 15 into position in the insert.

In this configuration, i.e. the one shown in FIG. 2, the cavity 7A is perfectly sealed off from the dust in the external environment, although there are air connections created between the cavity 7A and the external environment during steps 305 and 207.

The configuration shown, furthermore, makes it possible to verify whether the contents of the cavity 7A are intact, simply by means of a visual inspection of the condition of the breakable portions of the insert and the shutter.

Returning to the description of the invention, it should be noted that the second section 15B of the shutter plays a very important role in the container 1.

In fact, the said second section comprises a surface 16 configured to cooperate in a sealed manner with the tubular member 12 (and more specifically, with an external surface thereof), when the second section 15B is fitted there onto.

The second section 15B of the shutter also comprises a breakable wall 18 (which can form its own roof) which, when broken, permits access to the containment element 7A.

When, meanwhile, the second section 15B of the shutter is fitted onto the tubular member 12 and the breakable wall 18 is intact, the second section 15B acts as a cap, and the interior of the cavity 7A is perfectly sealed off. This condition will be examined in more detail later on in the description, also in relation to the role of the second part 11B of the intermediate element.

The method for filling the container described above is essentially as follows.

Preliminarily, a container is provided in the configuration just described and shown in FIG. 2.

Figure 3:
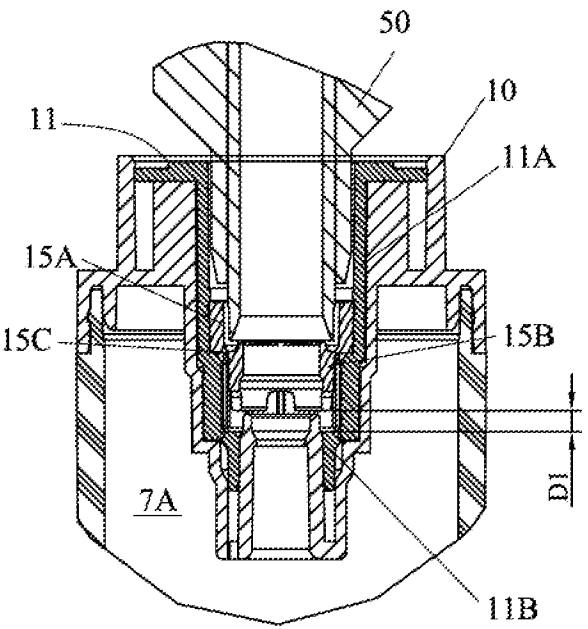

Subsequently, a filling nozzle 50 is provided, which is hollow and is placed resting on the second section 15B of the shutter, as can be seen clearly in FIG. 3.

In this configuration it can be seen that there is a distance D1 between the bottom of the second section 15B of the shutter 11 and the side facing the shutter of the second part 11B of the insert 11.

Subsequently, the second section 15B of the shutter is pushed (by means of the nozzle) until the second breakable portion 15C is broken, thereby separating the first section and the second section of the shutter 15.

It should be noted that during this step, the first section 15A remains firmly in position, as it is abutting against the step 32 on the insert.

The second section 15B of the shutter, meanwhile, can slide towards the tubular member 12, the stroke thereof stopping against the second part 11B of the insert. Regarding this, see FIG. 4, where the distance D1 is zero.

In practice, when the first breakable portion 11C of the insert 11 is intact, the second part 11B constitutes a stop to end the movement of the second section 15B of the shutter.

Figure 4:
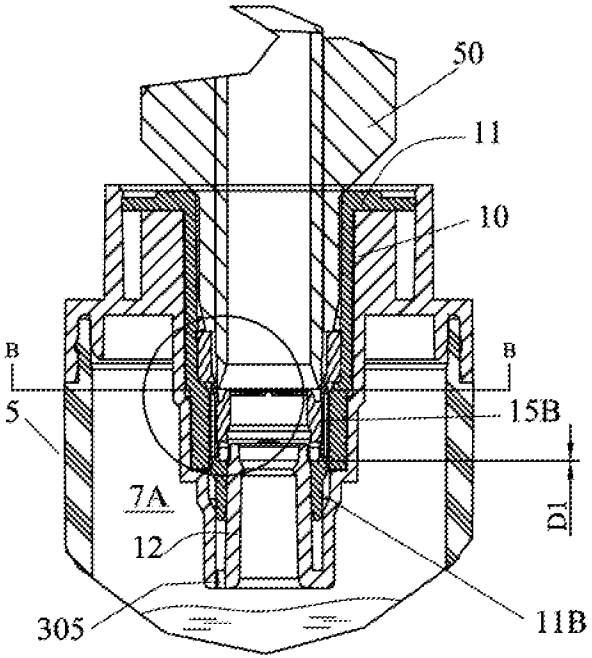

In the position in FIG. 4, it is therefore possible to dispense the fluid substance from the nozzle until the cavity 7A is filled with the desired amount, with the consequent lowering of the mobile bottom.

Figure 4B:
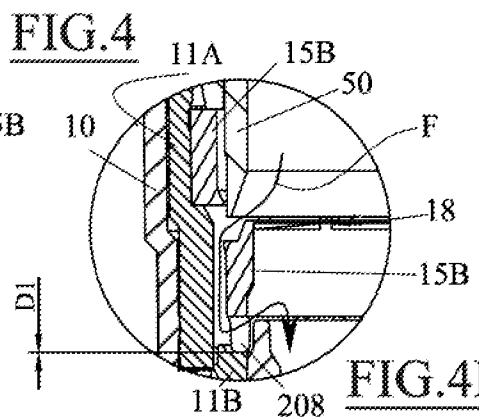
FIG. 4B is an enlarged, simplified representation of the part circled in FIG. 4.

In the enlargement in FIG. 4B, one can see the route (arrow F) of the fluid substance during the filling of the cavity 7A.

To allow the flow F of the fluid substance, the second section 15B of the shutter 15 envisages a lower surface featuring second passages 208 for filling the cavity 7A by means of the tubular member 12. The second passages 208 remain open even when the second section 15B is resting on the said second part 11B of the insert 11.

In the example described, these second passages 208 are arched flow-through cavities, but may have other suitable shapes, such as radial flow-through holes, gaps between specially envisaged fins, etc.

During the filling step, any air present in the cavity 7A (if the bottom was not in contact with the collar 10 at the beginning of the filling operation, as shown in FIG. 2) can vent outwards freely through the passage 305, which may be located, for example, on the bottom of the cup-shaped part of the collar 10. In the configuration illustrated, the air flowing through the passage 305 vents outwards through the gap 207 which may be provided between the collar 10 and the insert 11.

Once the filling operation of the cavity 7A is complete, which (as already mentioned) may also be only partial (depending on the requirements and the amount of the fluid substance one wishes to market), the nozzle is driven further towards the tubular member 12.

The thrust imparted against the nozzle 50 acts against the second section 15B of the shutter, which is resting on the second part 11B. The nozzle thrust continues until the first breakable portion 11C breaks.

Figure 5:
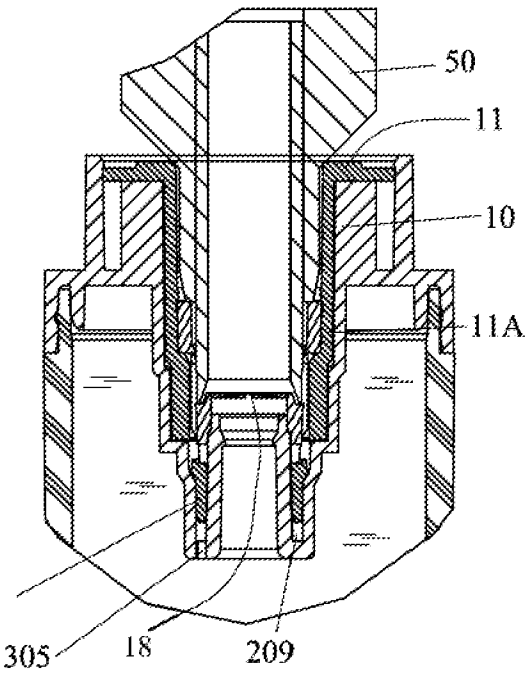
FIGS. 3, 4, and 5 show a sequence of operating steps consisting of the filling of the container according to the present invention.

At this point, the nozzle movement continues until the second section 15B of the shutter 15 is fitted onto the tubular member 12, forming a cap and thereby closing the first passage 20 in a sealed manner (see FIG. 5).

Conversely, the second part 11B of the insert, once detached, positions itself inside a groove 209 in the collar 10, thereby closing up the passage 305 in a sealed manner.

Figure 4A:
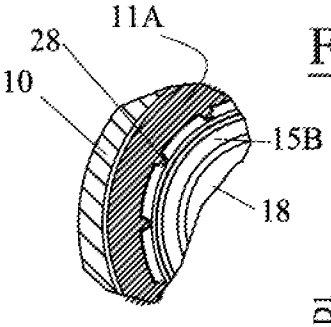
FIG. 4A is a partial, simplified section taken along line B-B of FIG. 4.

It should be noted that the insert 11 may feature guides 28 (clearly visible in the cross section in FIG. 4A and in FIG. 6) which cooperate with the second section 15B of the shutter 15 when—that is—the second breakable part 15C is broken. The guides keep the second section 15B on the same axis and aligned during the movement thereof induced by the nozzle 50.

Furthermore, to further simplify the mechanics of the movement of the nozzle 50, the second breakable portion 15C may be configured to break under a load lower than that of the first breakable portion 11C.

Figure 6:
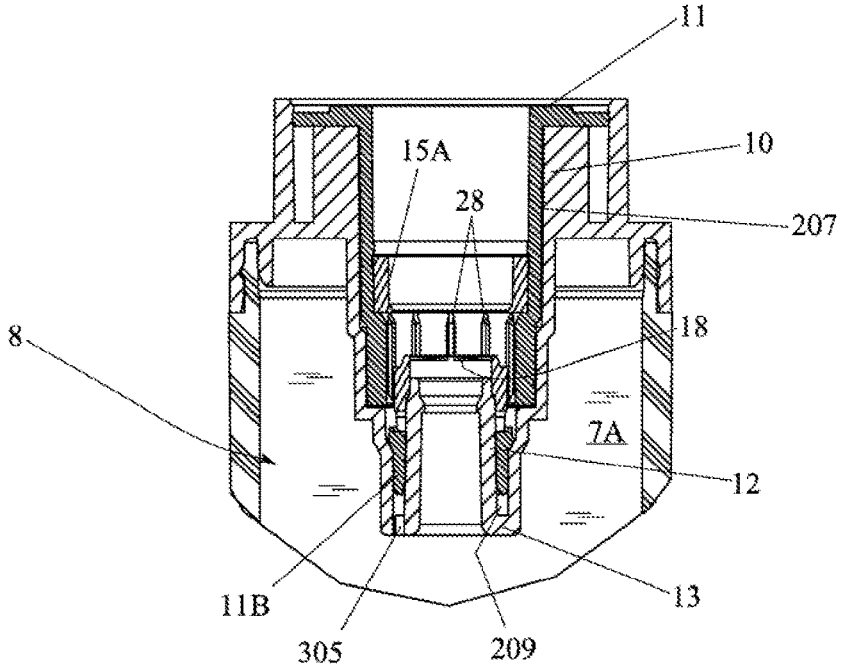
FIG. 6 shows the container in FIG. 1 in a transportation/storage configuration after filling.

At the end of the steps described above, and once the nozzle has been removed, the container 1 is presented as shown in FIG. 6.

As can be seen, in this configuration, the contents 8 of the cavity 7A are perfectly sealed off from the external air, thanks to the presence of the second section 15B of the shutter, which acts as a cap fitted onto the tubular member 12, and of the second part 11B of the insert, which closes off the passage 305.

In the configuration in FIG. 6, the container may be stored, handled, relocated, etc, without the risk of contamination of the fluid substance 8 enclosed there within.

It is also possible to check the contamination status and, at the same time, whether the breakable wall 18 is intact.

Only at the final step of the assembly is it possible to couple a pump (for dispensing the fluid substance) with the container 1.

The pump 100 may be manual and of the airless type (i.e. it does not allow air to enter the cavity 7A). The said pump may be configured for creams, such as that illustrated, or be equipped with a known spray-dry nozzle of a conventional kind.

Figure 7:
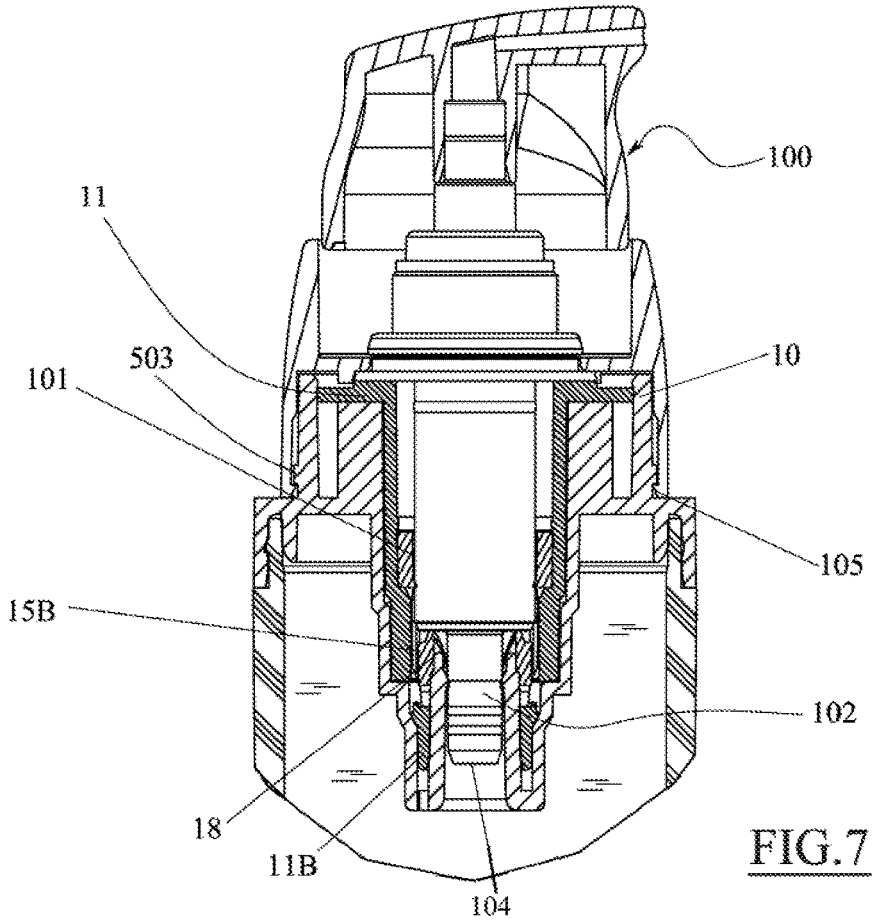
FIG. 7 is a section of the container in FIG. 6 once a dispensing pump has been coupled.

To switch from the configuration in FIG. 6 to that in FIG. 7, one simply has to forcibly push the end 104 of a dip tube 102 (part of the dispensing pump 100) against the breakable wall 18 of the second section 10B of the shutter 15, so that the said end breaks the said wall, allowing the dip tube to enter the cavity 7A. Advantageously, the dip tube end 104 is configured to enter, at least partially, the tubular member 12.

Furthermore, the pump 100 may be sealed onto the insert either by means of a specially provided seal 101 or directly with the internal surface of the tubular member 12.

In the case of the pump illustrated, merely by way of example, the said pump may be fitted onto the collar 10 (or retaining ring) and snap-fastened there onto by means of suitable fastening teeth 105 which collaborate with the protrusions 503 on the collar 10.

Obviously, there are possible alternative methods of fastening the pump 100 to the collar, to the body 5, or to a further external container, which may be—for example—of a decorative type, inside which the body 5 is housed, and to which the pump 100 may be fastened. In this case, the further container covering the body 5 may feature high production quality, and in practice, the body 5—together with the fastening described above—acts as a refill which is opened by means of the insertion of the pump and the coupling thereof with the further container.

In a further embodiment, the collar 10 is devoid of the ventilation passage 305, and between the collar 10 and the insert 11 there is a seal envisaged at least when the preferential breaking zone between the first part 11A and the second part 11B is intact. In addition to the ventilation passage 305, the gap 207 is therefore not present.

The area in which the seal is made is located at the interface between the collar and the insert and may also be present instead of the gap 207.

The embodiment described herein does not allow the expulsion of the air present in the cavity 7A prior to filling. Therefore, in this case, it is possible to bring the mobile bottom up to a raised position next to the collar, in order to minimise the quantity of the air present in the cavity 7A, before filling.

Advantageously, in this case and as also shown in the figure relating to the embodiment described above, the bottom has a complementary shape to the part of the collar 10 facing the cavity 7A. In this way, when the bottom 500 is next to the collar, the quantity of air between them is minimal. This bottom shape is also useful to allow essentially complete expulsion of the fluid to be dispensed, which is present in the cavity 7A. This bottom shape is also useful in the embodiment described previously.

The embodiment described here ensures perfect sealing off of the cavity 7A from the external air when the insert and the shutter are intact. In this way, it is even possible to supply the cavity 7A (before filling operations) in a vacuum-sealed or in any case in an (even only slightly) depressurised condition. These depressurised conditions (or in any case the intactness of the cavity 7A) may be verified visually by checking for breakage of the breakable zone 15C and of the membrane 18.

It must be said that, optionally, it is possible to suck the air out of the cavity 7A so as to raise the bottom 500, (or it is possible to position the bottom at the top) before assembling the collar 10 or the insert 11 or the shutter 15.

Additionally, also before fitting the collar 10, the insert 11 or the shutter 15, it is possible to introduce pressurised air into the container 5 through the bleeder 509, so as to push the mobile bottom 500 upwards.

Ending the description, it should be noted that the various components of the container may be made of any material suitable for the purpose.

For example, the body 5 (or external container) may be made of plastic, metal, or another suitable material.

The collar 10, the insert 11, and the shutter 15, meanwhile, may be made by moulding plastics, each one being made as a single piece. Preferred plastic materials may be:

for the collar 10: PP/PE for the insert 11: PP/PE/HDPE/LDPE/TPE/TPU for the shutter 15: PP/PE/HDPE/LDPE/TPE/TPU In particular, the breakable wall 18 of the second portion 15B of the shutter may be a wall made of the same material as the shutter but thinner. The thinner wall may be obtained by adjusting the mould to create a thin cavity to house a thin layer of plastic. The surface of the breakable wall may feature scoring (for example in the shape of a Greek cross) to facilitate cutting.

Furthermore, the breakable portions of the shutter and the insert may be obtained by means of calibrated thinning of the constituent material of the insert and the shutter or with a mechanical pre-scoring of the plastic during the system assembly step.

Lastly, all the seals described above, and in particular those between the insert 11 and the collar 10 (where present), those between the insert 11 and the shutter 15, and those between the second section of the shutter and the tubular member 12, are obtained by exploiting the coupling tolerances of the various pieces and the slight deformation of the plastics in mutual contact. For example, it is possible to use a sealing system with a toroidal section with sections that deform and adapt to surfaces during the sliding steps (during assembly).

Various embodiments of the innovation have been disclosed herein, but further embodiments may also be conceived using the same innovative concept.

The invention claimed is:

1. A container for a fluid substance, comprising a body delimiting a cavity to contain the fluid substance, inside the cavity a mobile bottom sealedly movable on an internal wall of the body, a collar sealedly secured to the body, the collar having at least one resting surface on the body and a tubular member extending from a bottom of the collar, the tubular member defining a first passage of the fluid substance during use, an insert being located within the collar and being formed by a first and a second part mutually connected by a first breakable portion, and a shutter being located inside the insert and formed by a first section and a second section mutually connected by a second breakable portion, the second section comprising a surface configured to cooperate with the tubular member to close its passage when the second section is fitted on the latter and a breakable wall of the second section is un-broken while, when the second section is fitted on the tubular member and the breakable wall is broken, access within the cavity is permitted through the broken breakable wall.

2. The container according to claim 1, wherein the insert is secured to the collar by a snap coupling and/or in which a seal is provided between the insert and the collar.

3. The container according to claim 1, wherein the first section of the shutter is held in position within the insert by a rib protruding from an inner surface of the insert and/or by a step provided on an inner surface of the insert.

4. The container according to claim 1, wherein the collar is coupled to the body by a snap coupling.

5. The container according to claim 1, wherein the second part of the insert, when the first breakable portion is unbroken, forms a stop for the second section of the shutter when the second breakable portion is broken and said second section is pushed in the direction of the tubular member.

6. The container according to claim 1, wherein the second section of the shutter has a lower surface provided with second filling passages of the cavity through the tubular element, said passages being opened when the second section is resting on the second part of the insert.

7. The container according to claim 1, wherein the insert comprises guides cooperating with the second section of the shutter at least when the second breakable portion is broken.

8. The container according to claim 1, wherein the second breakable portion is configured to break at a lower load than that at which breaks the first breakable portion.

9. The container according to claim 1, comprising a dispensing pump comprising at least one feature selected from the group consisting of:

a dip tube provided with an end configured to break through the breakable wall;

a dip tube provided with an end configured to penetrate at least partially in said tubular member a seal with the insert, and fixing elements at least to the collar.

10. The container according to claim 1, wherein the collar comprises a closable passage for venting the air trapped in the cavity during its filling, and/or wherein an air vent is provided by at least one gap present between the body and the insert to vent the air passing through the passage.

11. A method for filling a container according to claim 1, wherein a hollow filling nozzle is predisposed in contact to the second section of the shutter, and subsequently:

the second section of the shutter is pushed through the nozzle until the second breakable portion is broken and, the second section of the shutter is pushed until it rests on the second part of the insert;

the fluid is delivered by the nozzle until it fills the cavity;

the second section of the shutter that rests on the second part of the insert, is pushed by the nozzle until the first breakable portion is broken and the nozzle movement continues until the second section is fitted on a collar tube, thus closing the first passage.

12. The method according to claim 11, wherein an end of a dip tube of a dispensing pump is pushed against the breakable wall of the second section of the shutter so as to break it, to allow the pump to suck the content of the cavity and the pump is fixed at least to the collar.

13. The method according to claim 12, wherein the insert is secured to the collar by a snap coupling and/or in which a seal is provided between the insert and the collar.

14. The method according to claim 12, wherein the first section of the shutter is held in position within the insert by a rib protruding from an inner surface of the insert and/or by a step provided on an inner surface of the insert.

15. The method according to claim 12, wherein the collar is coupled to the body by a snap coupling.

16. The method according to claim 12, wherein the second part of the insert, when the first breakable portion is unbroken, forms a stop for the second section of the shutter when the second breakable portion is broken and said second section is pushed in the direction of the tubular member.

17. The method according to claim 12, wherein the second section of the shutter has a lower surface provided with second filling passages of the cavity through the tubular element, said passages being opened when the second section is resting on the second part of the insert.

18. The container according to claim 1, further comprising a coupling means configured to secure the collar to the body and to form a seal there-between.

19. The container according to claim 18, wherein the coupling means is selected from the group consisting of a snap-fitting and a thread, and combinations thereof.

20. The container according to claim 1, wherein the second section of the shutter is movable relative to the second part of the insert upon breaking of the second breakable portion.

* * * * *